US008361242B2

(12) United States Patent
Blank et al.

(10) Patent No.: US 8,361,242 B2
(45) Date of Patent: Jan. 29, 2013

(54) POWDERS FOR RARE EARTH MAGNETS, RARE EARTH MAGNETS AND METHODS FOR MANUFACTURING THE SAME

(75) Inventors: Rolf Blank, Grosskrotzenburg (DE); Matthias Katter, Alzenau (DE); Werner Rodewald, Gründau (DE); Boris Wall, Langenselbold (DE)

(73) Assignee: Vacuumschmeize GmbH & Co. KG, Hanau (DE)

( * ) Notice: Subject to any disclaimer, the term of this patent is extended or adjusted under 35 U.S.C. 154(b) by 0 days.

(21) Appl. No.: 13/070,773

(22) Filed: Mar. 24, 2011

(65) Prior Publication Data

US 2011/0171056 A1 Jul. 14, 2011

Related U.S. Application Data

(62) Division of application No. 11/255,278, filed on Oct. 21, 2005.

(51) Int. Cl.
*H01F 1/057* (2006.01)

(52) U.S. Cl. ..... 148/101; 75/352

(58) Field of Classification Search ..... None
See application file for complete search history.

(56) References Cited

U.S. PATENT DOCUMENTS

| | | | | |
|---|---|---|---|---|
| 4,770,702 | A | 9/1988 | Ishigaki et al. | |
| 5,162,064 | A | 11/1992 | Kim et al. | |
| 5,217,543 | A | 6/1993 | Inokoshi | |
| 5,282,904 | A | 2/1994 | Kim et al. | |
| 5,656,100 | A | 8/1997 | Yamamoto et al. | |
| 5,788,782 | A * | 8/1998 | Kaneko et al. | 148/103 |
| 5,858,123 | A | 1/1999 | Uchida et al. | |
| 6,296,720 | B1 | 10/2001 | Yamamoto et al. | |
| 6,474,576 | B1 | 11/2002 | Oota et al. | |
| 6,648,984 | B2 | 11/2003 | Takaki et al. | |
| 6,676,773 | B2 * | 1/2004 | Kaneko et al. | 148/302 |
| 6,736,343 | B2 | 5/2004 | Oota et al. | |
| 6,752,879 | B2 | 6/2004 | Takaki et al. | |
| 7,199,690 | B2 | 4/2007 | Hidaka et al. | |
| 2002/0054824 | A1 | 5/2002 | Tokoro et al. | |
| 2002/0117237 | A1 | 8/2002 | Takaki et al. | |
| 2004/0187962 | A1 * | 9/2004 | Ishizaka et al. | 148/101 |
| 2004/0187970 | A1 | 9/2004 | Ishizaka et al. | |
| 2004/0189426 | A1 | 9/2004 | Hidaka et al. | |
| 2006/0231165 | A1 | 10/2006 | Kato et al. | |
| 2007/0102069 | A1 | 5/2007 | Hidaka et al. | |

FOREIGN PATENT DOCUMENTS

| | | | |
|---|---|---|---|
| DE | 10011300 | A1 | 9/2000 |
| EP | 0 680 054 | A1 | 11/1995 |
| EP | 1 005 050 | A2 | 5/2000 |
| EP | 1 014 392 | A2 | 6/2000 |
| EP | 1 014 392 | B1 | 6/2000 |
| EP | 1 154 444 | A1 | 5/2001 |
| EP | 1 562 203 | A1 | 9/2004 |
| JP | 04-007804 | | 1/1992 |
| JP | 2000-234151 | | 8/2000 |

OTHER PUBLICATIONS

Kaneko, Y., "Highest Performance of Nd—Fe—B Magnet over 55 MGOe," IEEE Trans. Magnetics, vol. 36, No. 5, Sep. 2000, pp. 3275-3278.

* cited by examiner

*Primary Examiner* — John Sheehan
(74) *Attorney, Agent, or Firm* — Buchanan Ingersoll & Rooney PC

(57) ABSTRACT

A powder consists essentially by weight, of 28.00≦R≦32.00%, where R is at least one rare earth element including Y and the sum of Dy+Tb>0.5, 0.50≦B≦2.00%, 0.50≦Co≦3.50%, 0.050≦M≦0.5%, where M is one or more of the elements Ga, Cu and Al, 0.25 wt %<O≦0.5%, 0.15% or less of C, balance Fe.

30 Claims, 11 Drawing Sheets

FIG 12

| Sample | Hydrogenation Conditions | | | Results | | | | | |
|---|---|---|---|---|---|---|---|---|---|
| | T | p, H2 | t, max | t, knee | Δm | ΔV from m | ΔV from p | ΔV/Δt, max, m | ΔV/Δt, max, p |
| | (°C) | (bar) | (h) | (h) | (%) | (l/kg) | (l/kg) | (l/kgh) | (l/kgh) |
| RS 1106 a | 450 - 500 | 0.3 | 3.5 | | 0 | | | | |
| RS 1106 b | 500 | 0.8 | 3 | 0.88 | 0.058 | 6.4 | 11.3 | 7.3 | 12.9 |
| RS 1106 c | 500 | 1 | 6 | 2.44 | 0.089 | 9.,8 | 11.7 | 4 | 4.8 |
| RS 1106 g | 550 | 1 | 6 | 1.27 | 0.121 | 13.3 | 13 | 10.5 | 10.2 |
| RS 1116 f | 400 | 1 | 5 | 0.56 | 0.056 | 6.2 | 20.5 | 11 | 36.6 |
| RS 1116 i | 400 | 1 | 7.43 | 3.02 | 0.117 | 12.9 | 17.5 | 4.3 | 5.8 |
| RS 1116 h | 450 | 1 | 6 | 1.39 | 0.111 | 12.2 | 19.5 | 8.8 | 14 |
| RS 1116 a | 450 - 550 | 0.3 | 3.76 | 3.76 | 0.03 | 3.3 | 4.5 | 0.88 | 1.2 |
| RS 1116 d | 500 | 0.6 | 6 | 4.46 | 0.119 | 13.1 | 16.5 | 2.9 | 3.7 |
| RS 1116 b | 500 | 0.8 | 3.5 | 1.51 | 0.099 | 10.9 | 14 | 7.2 | 9.3 |
| RS 1116 m, at 300°C to air | 500 | 1 | 6 | 1.66 | 0.66 | | 16 | | 9.6 |
| RS 1116 n, at 200°C to air | 500 | 1 | 6 | 2.27 | 0.18 | | 17.5 | | 7.7 |
| RS 1116 p, at 100°C to air | 500 | 1 | 6 | 2.49 | 0.114 | 12.5 | 19.7 | 5 | 7.9 |
| RS 1116 c | 500 | 1 | 6 | 1.1 | 0.115 | 12.7 | 19.5 | 11.5 | 17.7 |
| RS 1116 k, 5-10 mm | 500 | 1 | 6 | 0.68 | 0.097 | 10.7 | 18 | 15.7 | 26.9 |
| RS 1116 o, 1-2 mm | 500 | 1 | 6 | 0.0119 | 0.144 | 15.8 | 18.2 | 1326 | 1524 |
| RS 1116 l, 1-2 mm | 550 | 1 | 6 | 0.0669 | 0.14 | 15.4 | 14.4 | 230 | 216 |
| RS 1116 g | 550 | 1 | 6 | 0.85 | 0.132 | 14.5 | 16 | 17.1 | 18.8 |
| RS 1116 e | 600 | 1 | 6 | 4.15 | 0.205 | 22.6 | 20 | 5.4 | 4.8 |
| RS 1116 j | 700 | 1 | 9.59 | 9.59 | 0.27 | 29.7 | 33.5 | 3.1 | 3.5 |
| RS 1117 a | 450 - 500 | 0.3 | 3.61 | 3.61 | 0.023 | 2.5 | 3.5 | 0.7 | 0.97 |
| RS 1117 b | 500 | 0.8 | 2.78 | 2.39 | 0.092 | 10.1 | 13.8 | 4.2 | 5.8 |
| RS 1117 c | 500 | 1 | 6 | 2.34 | 0.111 | 12.2 | 15 | 5.2 | 6.4 |
| RS 1117 g | 550 | 1 | 6 | 1.46 | 0.109 | 12 | 13.7 | 8.2 | 9.4 |
| 74/1273 | 450 | 0.5 - 1.5 | 3 | 0.012 | 0.082 | | 11.1 | | 1520 |
| 74/5980 c | 500 | 1 | 6 | 1.41 | 0.076 | 7.3 | 13.4 | 5.1 | 9.5 |
| 74/5984 c | 500 | 1 | 6 | 1.51 | 0.079 | 8.7 | 13.3 | 5.8 | 8.8 |
| 74/6004 c | 500 | 1 | 6 | 1.32 | 0.074 | 8.1 | 11.7 | 6.2 | 8.9 |
| 74/5895 c | 500 | 1 | 6 | 1.51 | 0.097 | 10.2 | 14.3 | 6.8 | 9.4 |

FIG 13

| Sample | Hydrogenation Conditions | | | | |
|---|---|---|---|---|---|
| | T | p, H2 | t, max | time | 500 μm |
| | (°C) | (bar) | (h) | (d) | (%) |
| RS 1106 a | 450-550 | 0.3 | 3.5 | 197 | 0.45 |
| RS 1106 b | 500 | 0.8 | 3 | 174 | 5.67 |
| RS 1106 c | 500 | 1 | 6 | 155 | 0.36 |
| RS 1106 g | 550 | 1 | 6 | 154 | 0.50 |
| RS 1116 t | 400 | 1 | 5 | 88 | 16.4 |
| RS 1116 f +300°C/2h/air | | | | 59 | 92.3 |
| RS 1116 i | 400 | 1 | 7.43 | 53 | 1.40 |
| RS 1116 h | 450 | 1 | 6 | 85 | 4.03 |
| RS 1116 a | 450-550 | 0.3 | 3.76 | 88 | 0.48 |
| RS 1116 d | 500 | 0.6 | 6 | 63 | 3.03 |
| RS 1116 b | 500 | 0.8 | 3.5 | 70 | 0.38 |
| RS 1116 m, at 300°C to air | 500 | 1 | 6 | 107 | 99.82 |
| RS 1116 n, at 200°C to air | 500 | 1 | 6 | 106 | 0.88 |
| RS 1116 p, at 100°C to air | 500 | 1 | 6 | 99 | 0.56 |
| RS 1116 c | 500 | 1 | 6 | 64 | 1.66 |
| RS 1116 c +300°C/2h/air | | | | 59 | 86.6 |
| RS 1116 k, 5-10 mm | 500 | 1 | 6 | 44 | 1.63 |
| RS 1116 o, 1-2 mm | 500 | 1 | 6 | 101 | 4.74 |
| RS 1116 l, 1-2 mm | 550 | 1 | 6 | 39 | 5.22 |
| RS 1116 g | 550 | 1 | 6 | 86 | 3.64 |
| RS 1116 e | 600 | 1 | 6 | 88 | 3.33 |
| RS 1116 e +300°C/2h/air | | | | 59 | 2.07 |
| RS 1116 j | 700 | 1 | 9.59 | 77 | 0.70 |
| RS 1117 a | 450-550 | 0.3 | 3.61 | 189 | 0.67 |
| RS 1117 b | 500 | 0.8 | 2.78 | 170 | 0.61 |
| RS 1117 c | 500 | 1 | 6 | 152 | 2.87 |
| RS 1117 g | 550 | 1 | 6 | 73 | 2.59 |
| 74/5980 c | 500 | 1 | 6 | 133 | 3.42 |
| 74/5984 c | 500 | 1 | 6 | 140 | 33.56 |
| 74/6004 c | 500 | 1 | 6 | 132 | 0.53 |
| 74/5895 c | 500 | 1 | 6 | 64 | 2.65 |
| RS 1108/09, 10 mm | 530-600 | 1 | 3 | 78 | 1.28 |
| RS 1107, 20 mm | 530-600 | 1 | 3 | 78 | 4.71 |
| RS 1119, at 100°C to air | 600 | 1 | 6 | 143 | 1.47 |
| RS 1127, at 70°C to air | 550 | 1 | 5 | 52 | 0.18 |
| RS 1128, at 70°C to air | 550 | 1 | 5 | 52 | 0.81 |
| RS 1129, at 70°C to air | 550 | 1 | 5 | 52 | 0.46 |
| RS 1130, at 70°C to air | 550 | 1 | 5 | 52 | 0.52 |

FIG 14

| Sample | time (day) | mean diameter (cm) | fraction <500μm (%) | Impurity pick up for a 2.5cm cube after 100 days | | |
|---|---|---|---|---|---|---|
| | | | | Cx (%) | Ox (%) | Nx (%) |
| RS 1127, at 70°C to air, HD=550°C | 52 | 2.0 | 0.18 | 0.001 | 0.086 | -0.012 |
| RS 1128, at 70°C to air, HD=550°C | 52 | 2.0 | 0.81 | 0.004 | 0.098 | -0.005 |
| RS 1116p, at 100°C to air, HD=500°C | 99 | 2.5 | 0.56 | 0.009 | 0.102 | -0.007 |
| RS 1116n, at 200°C to air, HD=500°C | 106 | 2.5 | 0.88 | -0.007 | 0.250 | 0.002 |
| RS 1116m, at 300°C to air, HD=500°C | 107 | 2.5 | 99.80 | 0.033 | 1.396 | 0.132 |
| RS 1116c+300°C/2h/air, HD=500°C | 59 | 2.5 | 86.60 | 0.025 | 2.054 | 0.021 |
| | | | | | | |
| RS 1116 e+300°C/2h/air, HD=600°C | 59 | 2.5 | 2.07 | 0.040 | 0.403 | 0.043 |

FIG 15

| Alloy | Ni layer thickness e [μm] | Total surface damage g [μm] | Surface damage of base material [μm] | Average grain sizie KG [μm] |
|---|---|---|---|---|
| Nd-Fe-M-B Magnet KG ca.9 μm | 12.4<br>12.4<br>12.4 | 17.0<br>16.5<br>14.0 | 10.8<br>10.3<br>7.8 | 7 - 11 |
| Nd-Fe-M-B Magnet KG ca.4,2 μm | 12.6<br>12.6<br>12.6 | 10.6<br>10.6<br>10.4 | 4.3<br>4.3<br>4.1 | 4.0 - 4.4 |
| Nd-Fe-M-B Magnet KG ca.4,2 μm | 16.3<br>16.3<br>16.3 | 10.5<br>11.1<br>10.5 | 2.3<br>2.9<br>2.3 | 4.0 - 4.4 |

POWDERS FOR RARE EARTH MAGNETS, RARE EARTH MAGNETS AND METHODS FOR MANUFACTURING THE SAME

This application claims the benefit under 35 U.S.C. §120 of the filing date of U.S. Patent Application No. 11/255,278 entitled POWDERS FOR RARE EARTH MAGNETS, RARE EARTH MAGNETS AND METHODS FOR MANUFACTURING THE SAME, filed Oct. 21, 2005, the entire contents of which is hereby incorporated herein by reference.

TECHNICAL FIELD

The present invention relates to powders for rare earth-iron-boron-metal (R—Fe—B-M) permanent magnets and to methods of producing the powders and the magnets.

BACKGROUND

Permanent rare earth-iron-boron-metal (R—Fe—B-M) magnets are generally produced by powder metallurgical methods. Firstly, an ingot is produced by a casting method. The ingot may be produced by casting the molten alloy into a mold, where it cools comparatively slowly. Alternatively, the ingot may be produced by a rapid solidification method such as strip casting. The solidified ingot is typically given an annealing heat treatment to homogenise the composition.

The ingot may then be given a hydrogenation treatment which is typically used to coarsely pulverise the solidified ingot due to the effects of hydrogen embrittlement of phases within the alloy. The ingot, or resulting coarsely pulverised material, is then further pulverised to produce a powder.

A magnet is produced from the powder by powder metallurgy. The powder is compacted in a magnetic field to form a textured green body which is then given a sintering heat treatment in order to produce a permanent magnet.

It is known that the magnetic properties, in particular the coercive force and the squareness of the J(H) curve, as well as the corrosion resistance and the temperature stability of the sintered magnet depend on the grain size as well as on the composition of the magnet. The composition and grain size of the sintered magnet are, in turn, dependent on the particle size and composition of the powder. R—Fe—B-M powders are, however, rather difficult to manufacture in large quantities and, consequently, the powders and the magnets produced using them are relatively expensive.

It is, therefore, desired to produce high-quality rare earth iron boron (R—Fe—B-M) sintered magnets more cost effectively so as to promote all kinds of applications in which they can be used. It is also desired to improve the corrosion stability and the temperature stability of such magnets.

SUMMARY

The invention seeks to provide (R—Fe—B-M) powder and (R—Fe—B-M) sintered magnets which have high quality magnetic properties, an improved temperature and corrosion stability and which can be more cost-effectively produced.

The invention also seeks to provide cost-effective methods of manufacturing (R—Fe—B-M) powder and permanent (R—Fe—B-M) sintered magnets.

The invention provides a powder for use in a R—Fe—M-B type permanent magnet and a R—Fe-M-B type permanent magnet consisting essentially by weight, of $28.00 \leqq R \leqq 32.00\%$, where R is at least one rare earth element including Y and the sum of $Dy+Tb>0.5$, $0.50 \leqq B \leqq 2.00\%$, $0.50 \leqq Co \leqq 3.50\%$, $0.050 \leqq M \leqq 0.5\%$, where M is one or more of the elements Ga, Cu and Al, $0.25\text{ wt }\% < O \leqq 0.5\text{ wt }\%$, 0.15% or less of C, balance Fe.

The powder comprises an oxygen content of $0.25\text{ wt }\% < O \leqq 0.5\text{ wt }\%$. Although, in principle, an increased oxygen content is undesirable as the fraction of the hard magnetic phase and the remnance of the magnet is reduced, an oxygen content in this range has been found to provide an improved powder for use in R—Fe-M-B type permanent magnets and an improvement in the properties of the magnets.

Magnets produced from a powder having a very low oxygen content, in this context a very low oxygen content is used to describe an oxygen content of less than 0.25 wt %, easily get a coarse grain structure which has two disadvantages. During the sintering process, the particle size of the powder having an oxygen content of less 0.25 wt % is observed to increase, generally speaking, by a factor of around three. Therefore, a powder with an average particle size of 4 μm produces a magnet with an average grain size of 12 μm. However, as the grain size of the magnet increases, the coercive field strength is reduced. Therefore, the properties of the magnet are limited by the particle size of the powder. This problem is avoided by increasing the oxygen content of the powder to provide a powder with an oxygen content in the range $0.25\text{ wt }\% < O \leqq 0.5\text{ wt }\%$.

A further problem which is observed in magnets with an oxygen content of less than 0.25 wt % is the appearance of abnormal grain growth. Abnormal grain growth is used to describe the phenomenon in where a few grains grow faster and reach a size of several hundred microns whereas the rest of the magnet has a normal grain size of, for example around 12 μm. Abnormal grain growth leads to a deterioration of the squareness of the B—H loop.

It has been found that, by providing the powder with an oxygen content in the range according to the invention, the sintering activity is reduced. Consequently, the average grain size in magnets sintered from powder according to the invention is approximately only double rather than treble the average particle size of the powder.

For example, for a powder according to the invention which has an oxygen content $0.25\text{ wt }\% < O \leqq 0.5\text{ wt }\%$ and, a magnet produced from this powder with an average particle size of 4 μm has an average grain size of around 8 μm. This is in contrast to powders with an oxygen content outside of the range according to the invention which produce a magnet with an average grain size of 12 μm from a powder with an average particle size of 4 μm. Therefore, the coercive field strength of the magnet fabricated from powder of a particular particle size is increased as the grain size of the sintered magnet is reduced. For the same reason, abnormal grain growth is also reduced.

If the oxygen content is greater than 0.5 wt %, the remnance is more significantly reduced and the advantage provided by the increase in the coercive field strength is lost. In a further embodiment, the oxygen content is $0.3\text{ wt }\% \leqq O \leqq 0.45\text{ wt }\%$.

Powder for producing R—Fe—B-M magnets having a composition according to the invention also simplifies the manufacturing process. Since the grain size of the sintered magnet is only approximately double the particle size of the powder, the pulverisation process can be simplified as a magnet with a given grain size can be fabricated from powder with a larger particle size. Consequently, the pulverisation process may be simplified and the process time to carry out the pulverisation is reduced. The powder and magnets produced from the powder can, therefore, be manufactured more cost-effectively.

The use of gallium and copper additions in the powder for use in fabricating sintered R—Fe—B-M type magnets also provides advantages. Gallium and copper form molten phases with Nd and Co/Fe at the sintering temperature although they are not present in significant amounts in the hard magnetic phase.

Therefore, the advantage of the molten phase sintering, which produces a fast densification at relatively low sintering temperatures, is retained. Since only minor amounts of Ga and Cu can be dissolved in the hard magnetic $R_2Fe_{14}B$ grains, rapid grain growth is slowed down substantially. Therefore, the grain growth by sintering is also reduced and, as previously described, abnormal grain growth is avoided. Therefore, the additions of gallium and/or copper also influence the relationship between powder particle size and the grain size of the sintered magnet and further reduce the increase in grain size of a magnet sintered from powder of a particular particle size.

In a further embodiment of the powder and permanent magnet, R is one or more of the elements Nd, Pr, Dy and Tb, 0.50%<Co<1.5%, 0.05%<Ga<0.25% and 0.05%<Cu<0.20%.

The powder can have an average particle size according to FSSS (Fischer Sub-Sieve Size) in the range of around 4 μm to around 2.1 μm and contains no particles greater than around 20 μm. In an alternative embodiment, the powder has an average particle size according to FSSS in the range of around 2.5 μm to around 3 μm and contains no particles greater than around 15 μm. This powder can be used to fabricate magnets with good magnetic properties, since, as previously described, the composition of the powder with a composition according to the invention, leads to a reduced grain size of the magnet produced using the powder.

The permanent sintered magnet may have an average grain size of around 7.6 μm to around 4.2 μm. This provides the magnet with magnetic properties, in particular a J(H) curve and coercive force which are suitable for a wide rang of applications and provides a magnet with good corrosion resistance.

In an embodiment, a magnet has an average grain size of around 7.6 μm and in a HAST corrosion test has a mass loss of less than 1 mg/cm$^2$ after 10 days.

In an embodiment, a magnet has an average grain size of around 4.2 μm and in a HAST corrosion test has a mass loss of less than 0.1 mg/cm$^2$ after 10 days.

In a further embodiment, a magnet has an average grain size of around 4.2 μm and in a HAST corrosion test has a mass loss of less than 1 mg/cm$^2$ after 100 days.

The invention also relates to methods of producing powder for use in R—Fe—B-M and to magnets fabricated from R—Fe—B-M powders.

In a method an alloy comprising by weight, of 28.00≦R≦32.00%, where R is at least one rare earth element including Y and the sum of Dy+Tb>0.5, 0.50≦B≦2.00%, 0.50≦Co≦3.50%, 0.050≦M≦0.5%, where M is one or more of the elements Ga, Cu and Al, 0.25 wt %<0.5%, 0.15% or less of C, balance Fe is melted. The alloy is then cast to form at least one ingot, wherein the solidified ingot comprises finely dispersed α-Fe, and $R_2Fe_{14}B$ and R-rich constituents. The at least one ingot is annealed at a temperature in the range of approximately 800° C. to approximately 1200° C. under an inert atmosphere of Ar or under vacuum to form an ingot which is free of the α-Fe phase. The at least one ingot is treated in hydrogen gas in order to hydrogenate the R-rich constituents. The at least one ingot is then coarsely pulverised and a fine pulverisation of the coarsely pulverised powder is performed in an atmosphere comprising oxygen, oxidizing the powder. The finely pulverised powder comprises an oxygen content of 0.25 wt %<O≦0.5 wt %.

It has been found that the ingots may be more easily pulverised and that powder having a smaller particle size distribution can be produced using the method according to the invention. The casting conditions and homogenisation conditions of the invention produce an ingot or ingots which are essentially free of the α-Fe phase. This has been found to lead to a more reliable pulverisation of the ingots.

It has also been found that the introduction of oxygen during the fine pulverisation process hast he advantage that an oxide coating is formed on the outside of the pulverised powder particles. This improves distribution of the oxygen and the stability of the powder.

The alloy casting conditions and hydrogenation treatment of the invention also simplify the pulverisation process as the rare earth rich phases, formed during the casting process, are more easily and reliably hydrogenated. The hydrogenation conditions lead to a more uniform hydrogenation of the rare earth rich phases and to an improved cracking of the ingots. It is also possible to eliminate a coarse crushing step if sufficient cracking is achieved by the hydrogenation treatment.

In a further embodiment an alloy is melted in which R is one or more of the elements Nd, Pr, Dy and Tb, 0.50%<Co<1.5%, 0.05%<Ga<0.25% and 0.05%<Cu<0.20%.

In an embodiment, the said ingot has smallest dimensions in the range of 5 mm to 30 mm.

In an embodiment, the powder has an average particle size (FSSS) in the range of around 4 μm to around 2.1 μm and contains no particles greater than around 20 μm.

In an embodiment, the at least one ingot has dimensions in the range of 15 mm to 25 mm and said powder after said fine pulverisation has an average particle size (FSSS) in the range of around 4 μm to around 2.1 μm and contains no particles greater than around 20 μm.

In an embodiment, the hydrogenating is performed at a temperature between around 450° C. and 600° C.

In an embodiment, the hydrogenating is performed at a temperature between around 500° C. and 550° C.

In an embodiment, the hydrogenating is performed under 0.5 to 1.5 bars of hydrogen gas for between around 1 hour to around 10 hours.

In an embodiment, the hydrogenating is performed in 1 bar of hydrogen for around 5 hours.

In an embodiment, after said hydrogenating, said ingot is cooled to around 100° C. under Ar gas.

It was found that the decomposition of the ingots is reduced by selecting a hydrogenation temperatures of greater than 450° C. By avoiding decomposition of the ingots, the ingots can be more easily removed from the furnace and the composition of the final powder is more reliable as the ingots are less likely to absorb impurities such as O, C and N.

By selecting a hydrogenation temperature of less than around 600° C., the absorption of hydrogen is reduced to a level at which decomposition of the hardmagnetic $Nd_2Fe_{14}B$ compound into $NdH_2$, α-Fe and $Fe_xB$ is avoided.

In a further embodiment, the fine pulverisation is performed in two steps. This embodiment has the advantage that a reduced average particle size, as well as a smaller particle size distribution can be provided by a simple re-pulverisation of the finely pulverised powder.

A first fine pulverisation of the coarsely pulverised powder is performed in an inert atmosphere. A second fine pulverisation of said finely pulverised powder is then performed in an atmosphere comprising oxygen, oxidizing said finely pulverised powder. The finely pulverised powder comprises an oxygen content 0.25 wt %<O≦0.5 wt % after the second fine pulverisation.

In an embodiment, the first fine pulverisation and said second fine pulverisation is performed using a jet mill.

In an embodiment, after said first fine pulverisation, the powder has an average particle size (FSSS) of around 4 μm and a particle size distribution in which 30% of particles have a diameter of more than around 10 μm and around 1% of the particles have a diameter of greater than between around 20 μm and around 25 μm.

In an embodiment, after said second fine pulverisation, the powder has an average particle size (FSSS) in the range of around 4 μm to around 2.1 μm and contains no particles greater than around 20 μm.

In an embodiment, the powder has an average particle size (FSSS) of around 4 μm and a particle size distribution in which 30% of particles have a particle diameter of more than around 10 μm, and around 1% have a diameter of greater of between around 20 μm and around 25 μm after the first fine pulverisation. The powder has an particle grain size (FSSS) in the range of around 4 μm to around 2.1 μm and contains no particles greater than around 10 μm after the second fine pulverisation.

The invention also provides a method by which R—Fe—B-M powder is produced from a pre-cast ingot.

An alloy is provided which comprises by weight, of 28.00≦R≦32.00%, where R is at least one rare earth element including Y and the sum of Dy+Tb>0.5, 0.50≦B≦2.00%, 0.50≦Co≦3.50%, 0.050≦M≦0.5%, where M is one or more of the elements Ga, Cu and Al, 0.25 wt %<O≦0.5%, 0.15% or less of C, balance Fe. The alloy has the form of an ingot.

Similarly, to the previous embodiment, the pre-cast ingot is annealed at a temperature in the range of approximately 800° C. to approximately 1200° C. under an inert atmosphere of Ar or under vacuum to form an ingot which is free of the α-Fe phase. The ingot is then treated in hydrogen gas in order to hydrogenate the R-rich constituents and then coarsely pulverised. A fine pulverisation of the coarsely pulverised powder is performed in an atmosphere comprising oxygen, oxidizing said powder. The finely pulverised powder comprises an oxygen content of 0.25 wt %<O≦0.5 wt %.

In an embodiment, an alloy is provided in which R is one or more of the elements Nd, Pr, Dy and Tb, 0.50%<Co<1.5%, 0.05%<Ga<0.25% and 0.05%<Cu<0.20%.

In an embodiment, the powder has an average particle size (FSSS) in the range of around 2.5 μm to around 3 μm.

In an embodiment, the ingot has dimensions in the range of 20 mm to 30 mm.

In an embodiment, the hydrogenating is performed at a temperature between around 450° C. and 600° C.

In an embodiment, the hydrogenating is performed at a temperature of between around 500° C. and 550° C.

In an embodiment, the hydrogenating is performed under 0.5 to 1.5 bars of hydrogen gas for between around 1 hour to around 10 hours.

In an embodiment, the hydrogenating is performed under 1 bar of hydrogen for around 5 hours.

In an embodiment, after the hydrogenation, the ingot is cooled to around 100° C. under Ar gas.

The invention also relates to a method of producing a permanent R—Fe—B-M magnet. Powder is provided which consists essentially by weight, of 28.00≦R≦32.00%, where R is at least one rare earth element including Y and the sum of Dy+Tb>0.5, 0.50≦B≦2.00%, 0.50≦Co≦3.50%, 0.050≦M≦0.5%, where M is one or more of the elements Ga, Cu and Al, 0.25 wt %<O≦0.5%, 0.15% or less of C, balance Fe. The powder is compacted in a magnetic field to form a textured compact. The compact is then sintered to produce a magnet.

In an embodiment, the powder has an average particle size according to FSSS and said magnet has an average grain size. The average grain size of said magnet is no more than 2.5 times the average particle size of said powder.

In an alternative embodiment, the average grain size of said magnet is no more than twice the average particle size of said powder.

In an embodiment, a sintered magnet having an average grain size in a range of about 7.6 μm to about 4.2 μm is produced in the step of sintering.

In a further embodiment, the powder is fabricated by a two step fine pulverisation process. The powder after said second pulverisation has an average particle size according to FSSS of around 4.1 μm to around 2.6 μm and the magnet after sintering has an average grain size of around 7.6 μm to around 4.2 μm.

BRIEF DESCRIPTION OF THE DRAWINGS

The invention is now explained in detail in the following with reference to the drawings.

FIG. 12: Hydrogenating conditions and results of hydrogenated alloys, where $t_{knee}$ is the time after which saturation was reached, Δm is the weight gain, ΔV is the specific $H_2$ uptake, and $\Delta V/\Delta t_{max}$ is the maximum absorptions rate, each of which is calculated from the weight gain and/or the gas quantity added.

FIG. 13: Results showing the powdered decomposition product of hydrogenated and unhydrogenated ingots after storage in air under various conditions.

FIG. 14: Contamination uptake of hydrogenated and unhydrogenated alloys. The hydrogenated alloys were homogenised before the hydrogenation at 1060° C. to 1120° C. for 12 h to 60 h.

FIG. 15: Surface damage of nickel-coated sintered Nd—Fe—B-M magnets with various grain sizes.

DETAILED DESCRIPTION

Composition

Figure 1:
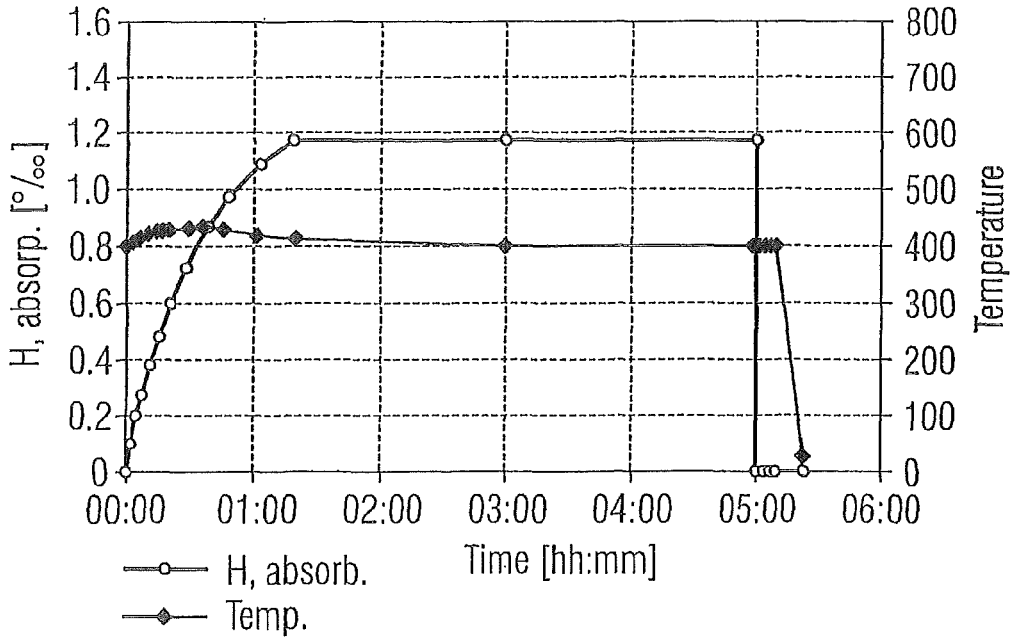
FIG. 1: Graph showing the percentage of $H_2$-absorbed by ingots with a size of around 20 mm to 30 mm at 400° C. and a $H_2$ pressure of about 1 bar.
Figure 2:
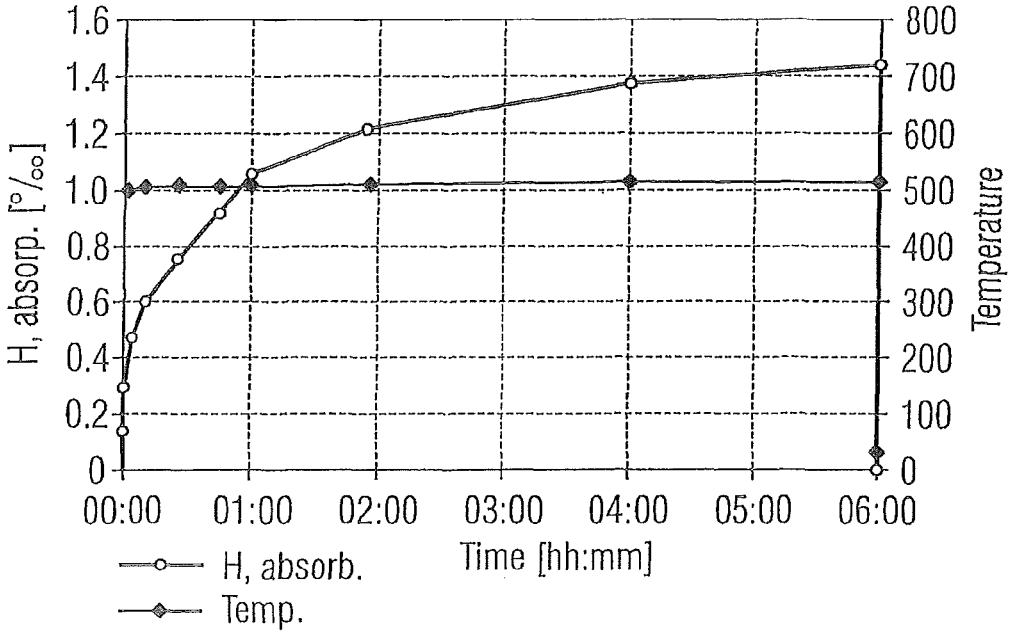
FIG. 2: Graph showing the percentage of $H_2$-absorbed by ingots with a size of around 1 mm to 2 mm at 500° C. and a $H_2$ pressure of about 1 bar.
Figure 3:
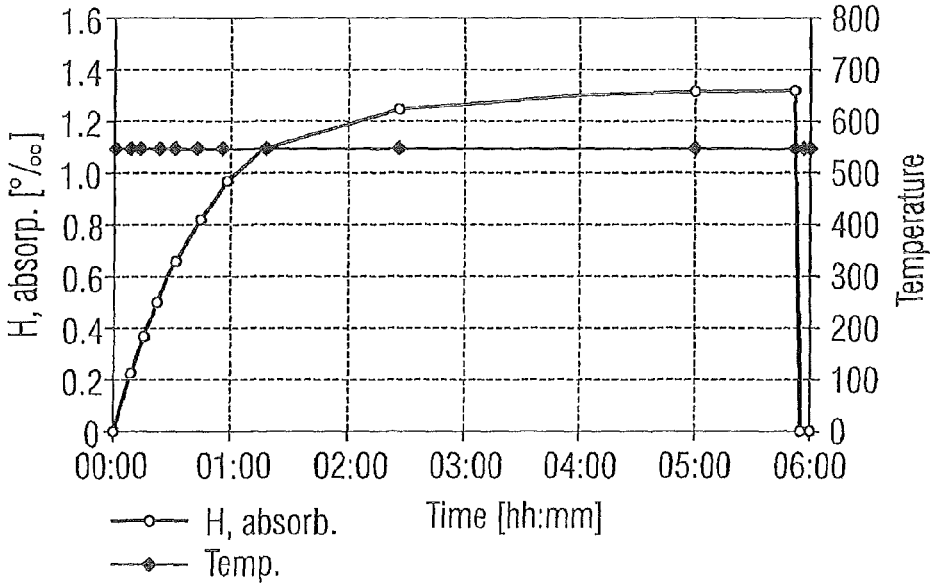
FIG. 3: Graph showing the percentage of $H_2$-absorbed by ingots with a size of around 20 mm to 30 mm at 550° C. and a $H_2$ pressure of about 1 bar.
Figure 4:
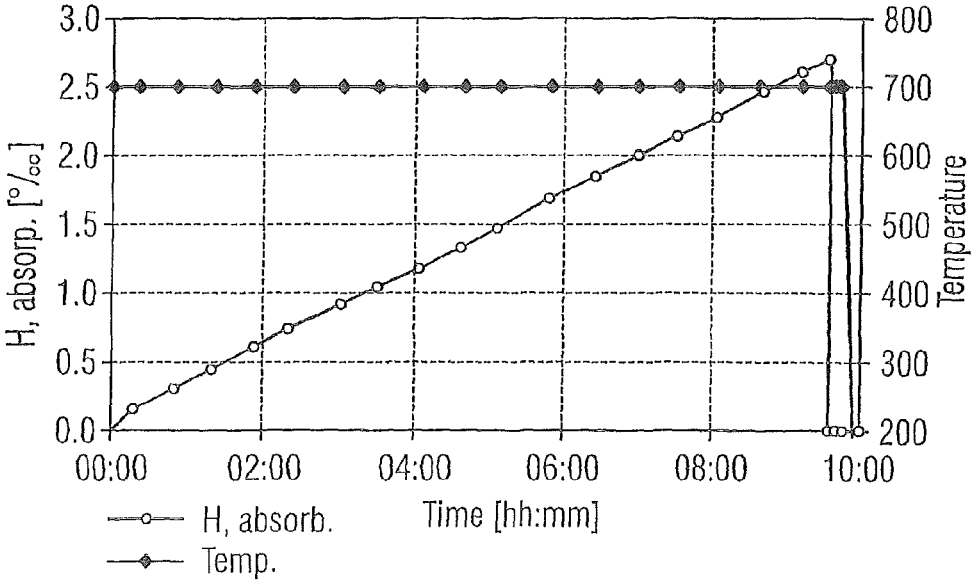
FIG. 4: Graph showing the percentage of $H_2$-absorbed by ingots with a size of around 20 mm to 30 mm at 700° C. and a $H_2$ pressure of about 1 bar.

A powder for use in a R—Fe-M-B type permanent magnet was fabricated using powder metallurgical techniques. An alloy having a composition of 30% Nd, 0.1% Pr, 0.2% Dy, 0.5% Tb, 0.93% B, 0.25% Ga, 0.7% Co, 0.08% Cu, 0.10% Al was melted and cast to produce plates having a thickness of 20 mm which comprise a finely dispersed α-Fe phase.

Casting and Homogenising

The cast plates were given a solid solution heat treatment at around 1120° C. for 12 hours. The ingots were then cooled to a temperature of between around 500° C. to around 550° C. under an atmosphere of argon in the furnace. After the homogenisation treatment, the ingots were essentially free from the α-Fe phase Hydrogenation A hydrogenation treatment was then performed on the homogenised ingots in order to enable the rare-earth rich phases remaining in the alloy to form Nd-hydrides and hence to be more easily pulverised. The hydrogenation treatment was carried out at a temperature in the range 500 to 550° C.

The hydrogenation heat treatment was carried out by replacing the argon by hydrogen and then maintaining the ingots under one bar of hydrogen at the desired temperature for around five hours.

After the hydrogenation heat treatment, the furnace was refilled with argon. The ingots were then cooled to around 100° C. in argon and then transferred in air into a container which was flushed with argon.

Results of experiments to determine the absorption rate are given in Table 1. The absorption rate was calculated from the weight gain and gas usage. The gas usage, was 10 to 15 l/kg of hydrogen with a maximum absorption rate of 10 to 20 l/kgh.

At hydrogenation temperatures of less than 500° C., the surface of the ingots was observed to decompose into a powder. The results of these experiments are given in Table 2. The formation of a powdered decomposition product is not desired as, firstly, the ingots cannot be easily removed from the furnace. Secondly, the composition of the final powder is adversely affected as the decomposition product easily picks up impurities such as O, C and N.

For hydrogenation temperatures of greater than around 550° C., an unexpectedly large amount of hydrogen was observed to be absorbed. It is thought that this is due to the decomposition of the hardmagnetic $Nd_2Fe_{14}B$ compound into $NdH_2$, α-Fe and $Fe_xB$ which is also undesired.

The results of further experiments are given in FIGS. 1 to 4 in which the effect of the hydrogenation temperature and size of the ingots on the maximum absorption rate was investigated. These results show that ingots with a size of 20 to 30 mm can be fully hydrogenated in the desired temperature range.

After the hydrogenation heat treatment was been carried out, the ingots were then further processed to produce a powder.

Stability of Ingots

The stability of hydrogenated alloy ingots was also investigated. The ingots were stored for 44 to 220 days in air and the percentage of the ingot which had decomposed was determined. The decomposition product has the form of a powder. Therefore, the percentage was determined by passing the sample through a 500 μm sieve and weighing the portion of the sample which had a grain size of less than 500 μm.

The results of these experiments are given in Table 2 and results in which the values have been normalised for an ingot size of 25 mm and a storage time of 100 days are given in table 3. Table 3 also gives the results of experiments to determine the uptake of O, C and N contamination during storage.

These results show that the ingots hydrogenated at 500 to 550° C. can be reloaded from the furnace even at 100° C. without significant increase of the oxygen pickup. Therefore, the handling of the hydrogenated ingots is much easier and consequently cheaper compared to the standard process, as disclosed in EP 0992309 B1.

Pulverisation

The ingots were then crushed to produce a coarse powder and then finely pulverised by milling the coarsely pulverised powder in a jet mill to produce a powder with an average particle size (FSSS) of around 3 μm.

It is known that the magnetic properties of the magnets produced using the powder are dependent on the grain size of the sintered magnet and on the particle size of the powder. In a further study the effects of performing a second fine pulverisation of the already finely pulverised powder was performed. The finely pulverised powder was milled for a second time in a jet mill and the effect of the second treatment on the average particle size and particle size distribution was investigated.

Figure 5:
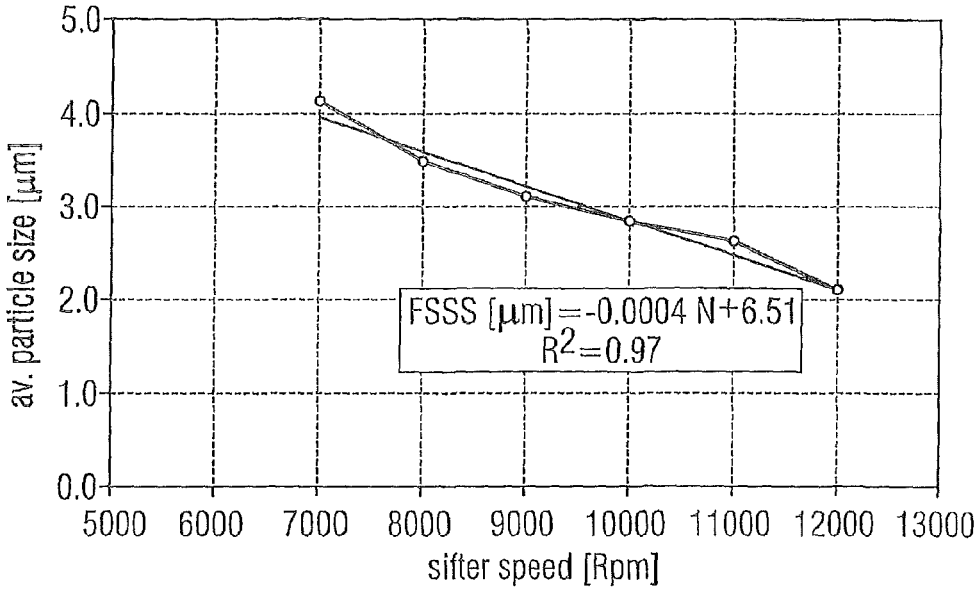
FIG. 5: Graph showing the effect of sifter rotation speed on average particle size according to FSSS of re-milled Nd—Fe-M-B alloy powder, where M is Al, Ga, Co, Cu.

A rare earth iron boron alloy powder with an average particle size of 4 μm was pulverised for a second time in a jet mill with increased sifter rotation speed. As can be seen in FIG. 5, the average particle size decreases with increasing sifter speed.

Figure 6:
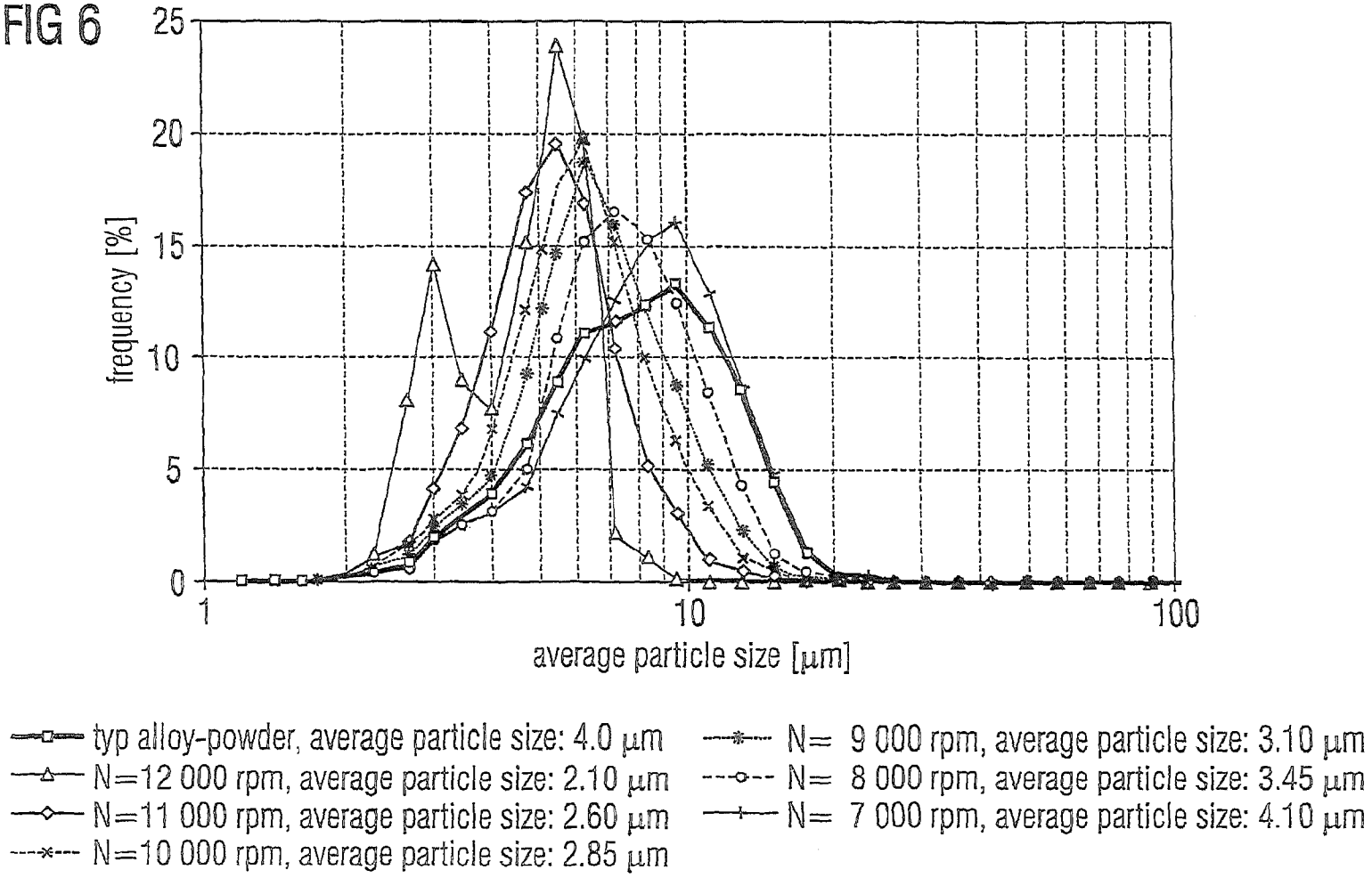
FIG. 6: Graph showing the effect of sifter rotation speed N on the particle size distribution of re-milled Nd—Fe-M-B alloy powder, where M is Al, Ga, Co, Cu.

The effect of sifter speed during the second pulverisation on the particle size distribution was also investigated. As can be seen from the results shown in FIG. 6, the width of the particle size distribution curve, which was measured by Fraunhofer diffraction, is reduced. It can be seen that the remilled powders contained essentially no particles with a size greater than 10 μm.

Magnets

Permanent magnets were fabricated from these powders. The powders were mixed with a lubricant, aligned in a magnetic field and isostatically pressed to form rods of diameter 40 mm and length 195 mm. The green bodies were then sintered at 1060° C. or 1070° C. for 3 hours in vacuum and 1 hour in Ar. The blocks were then given a further annealing treatment at 480° C.

Figure 7:
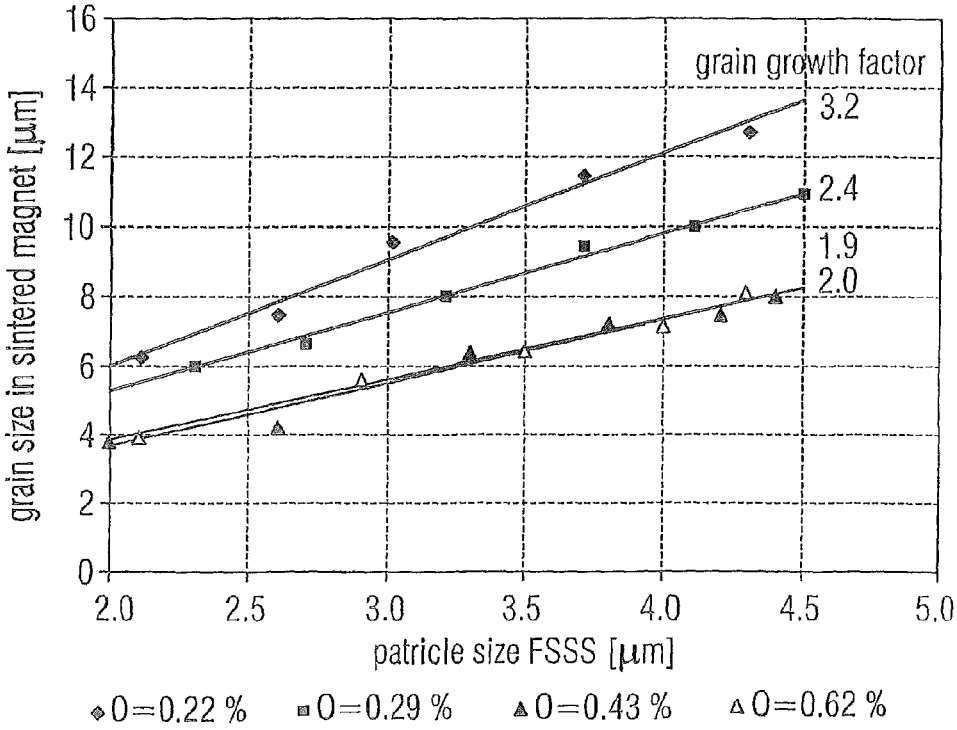
FIG. 7: Graph showing the relationship between grain size of the sintered magnet and particle size of the powder for different oxygen contents.

The relationship between the average grain size of the magnets in comparison with the average particle size of the powder from which it was fabricated was investigated, see FIG. 7. A magnet fabricated from powder with an average FSSS particle size of 4.2 μm has an average grain size of 7.6 μm and a magnet fabricated from powder with an average FSSS particle size of 2.6 μm has an average grain size of 4.1 μm. The grain size of the magnets is, therefore, less than double the particle size of the alloy powder from which it was made.

Also, FIG. 7 shows the relationship between the grain size of the sintered magnet and particle size (according to FSSS) of the powder for powders having different oxygen contents. A grain growth factor of 3.2 was observed for magnets produced from powders with an oxygen content of 0.22 wt %. A grain growth factor of 2.4 was observed for magnets produced from powders with an oxygen content of 0.29 wt %. A grain growth factor of 2.0 was observed for magnets produced from powders with an oxygen content of 0.43 wt %. A grain growth factor of 1.9 was observed for magnets produced from powders with an oxygen content of 0.62 wt %.

A reduced increase of the grain size is observed only for magnets with an oxygen content larger than 0.25 wt %. For magnets with an oxygen contact of less than 0.25 wt %, there is a large tendency to form a Very coarse and undesired microstructure.

Figure 8:
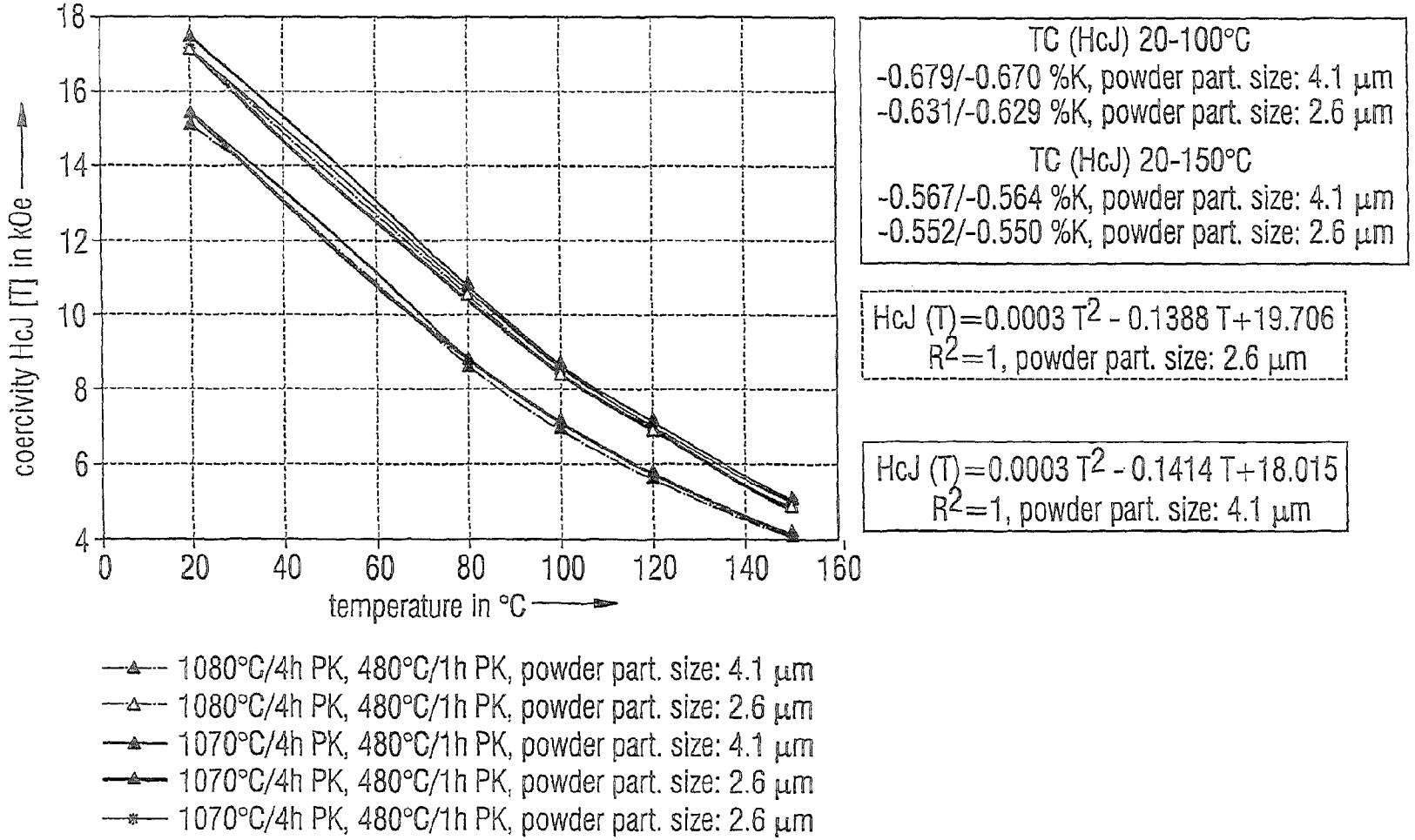
FIG. 8: Graph showing the temperature dependence of the coercivity field strength of Nd—Fe-M-B magnets, where M is Al, Ga, Co, Cu, fabricated from sintered powered with a particle size of 4.1 μm and 2.6 μm.
Figure 9:
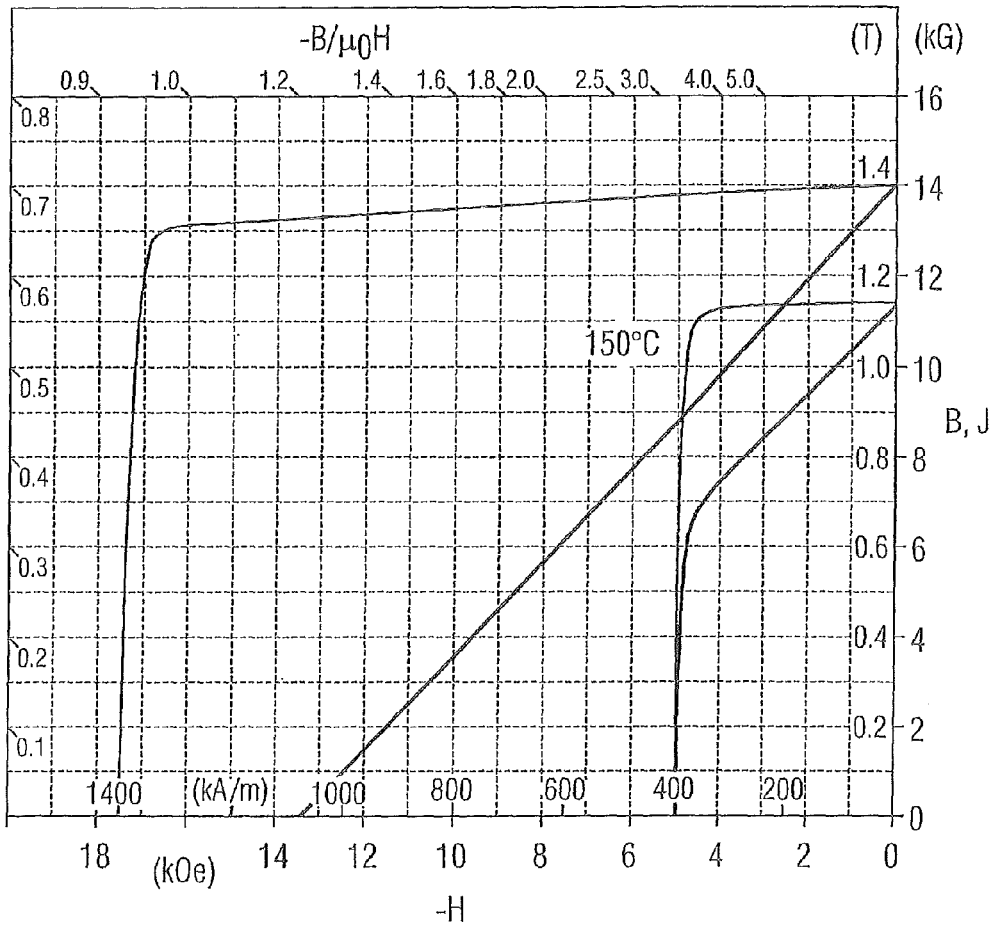
FIG. 9: Demagnetisation curves J(H) of Nd—Fe—B magnets, fabricated from sintered remilled Nd—Fe-M-B- powder, where M is Al, Ga, Co, Cu, with an average particle size of 2.6 μm.

The effect of the powder particle size on the coercive force of sintered magnets fabricated using the powder can be seen in FIG. 8. The coercive field strength increases from around 13 kOe for alloy powder with an particle size of 4 μm to around 16.5 kOe for a magnet fabricated from an alloy powder with an average particle size of 2.1 μm. The J(H) curves for these magnets are shown in FIG. 9. Because of their higher coercivity, fine grained magnets can be applied at higher temperatures.

Corrosion Resistance

Figure 10:
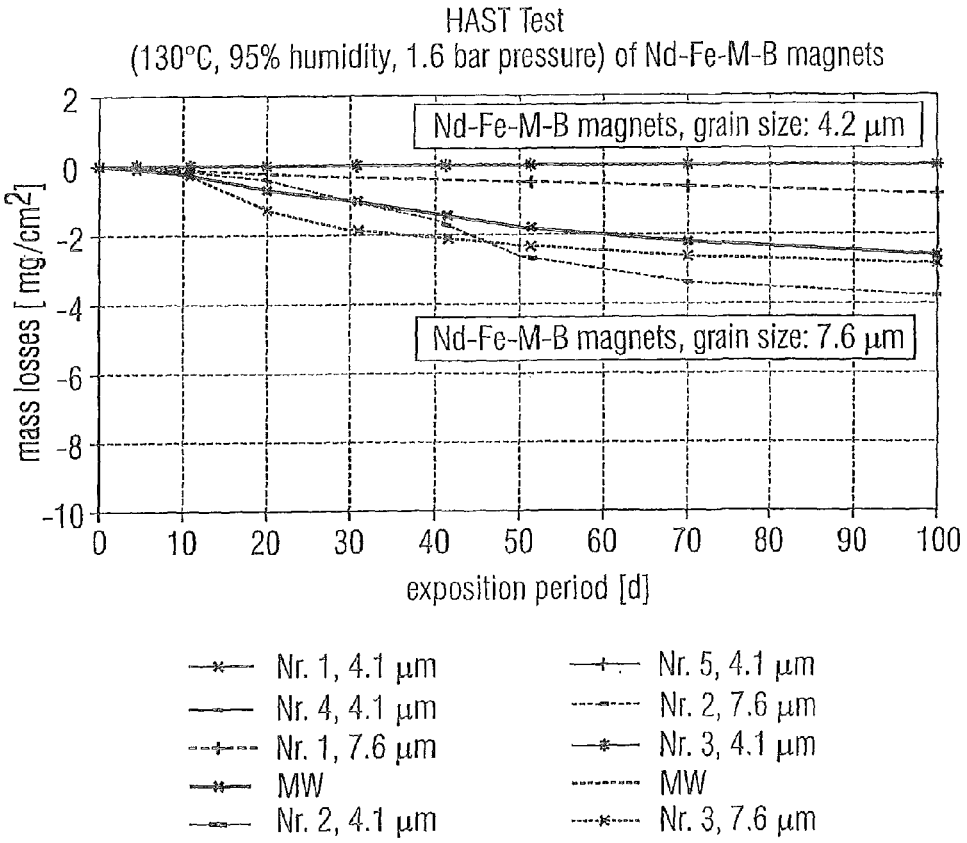
FIG. 10: Graph showing the weight increase in a HAST test of Nd—Fe-M-B-magnets, where M is Al, Ga, Co, Cu, with an average grain size of 7.6 μm and 4.2 μm which were fabricated from sintered powder with an average particle size of 4.1 μm and 2.6 μm respectively.
Figure 11:
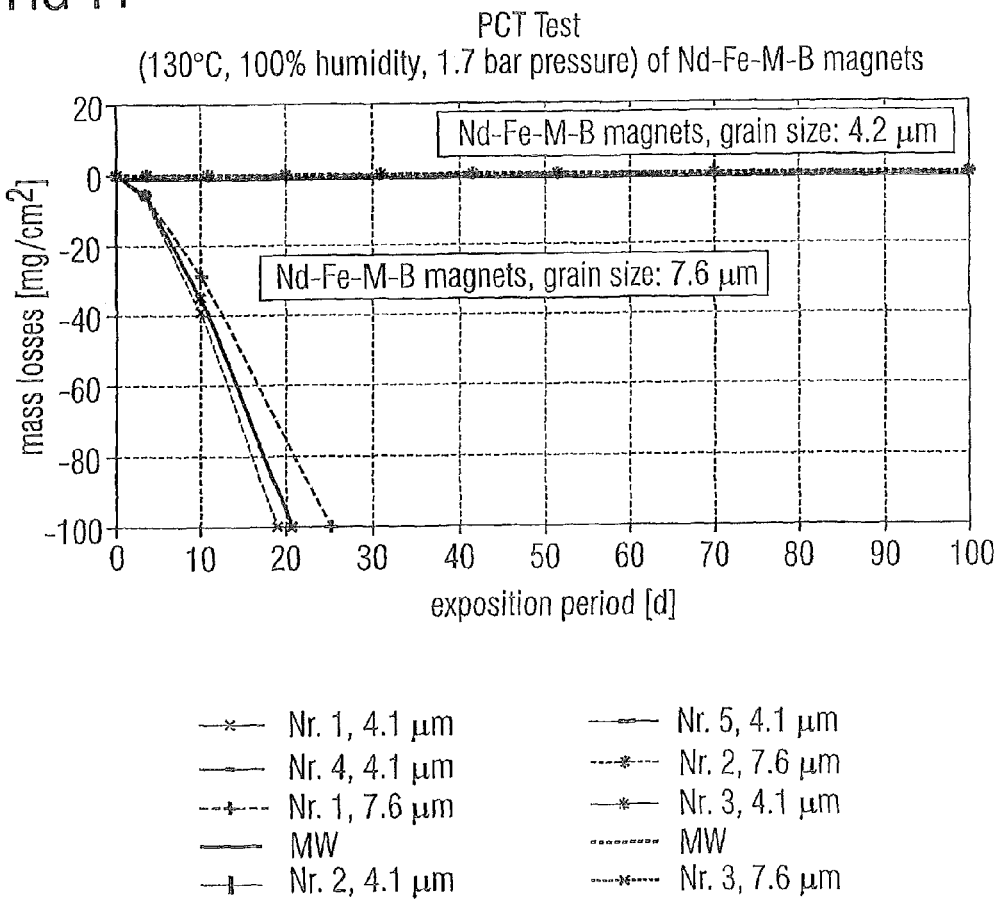
FIG. 11: Graph showing the weight increase in a PCT test of Nd—Fe-M-B-magnets, where M is Al, Ga, Co, Cu, with an average grain size of 7.6 μm and 4.2 μm which were fabricated from sintered powder with an average particle size of 4.1 μm and 2.6 μm respectively.

The corrosion resistance of magnets fabricated from powders of differing average particle size was also investigated. From the results of the highly accelerated stress test (HAST 130° C., 95% relative humidity, 2.6 bar pressure) and the pressure cooker test (PCT: 130° C., 100% humidity, 2.7 bar pressure) are shown in FIGS. 10 and 11. The magnets fabricated from alloy powders having a smaller average grain size have an improved corrosion resistance.

Table 4 shows the results from measurements of the surface damage to Ni coated magnets with a different average grain size. These results confirm that magnets with a smaller grain size show a reduced surface deterioration during coating.

What is claimed:

1. A method to produce powders for use in R—Fe—B—M type permanent magnets comprising:

melting an alloy consisting of, by weight, 28.00≦R≦32.00%, where R is at least one rare earth element including Y and the sum of Dy+Tb>0.5, 0.50≦B≦2.00%, 0.50≦Co≦3.50%, 0.050≦M≦0.5%, where M is one or more of the elements Ga, Cu and Al, 0.25 wt %<O≦0.5%, 0.15% or less of C, 0.15% or less of N, balance Fe;

casting said alloy to form at least one ingot, wherein the solidified ingot comprises finely dispersed α-Fe phase, and $R_2Fe_{14}B$ and R-rich constituents;

annealing said ingot at a temperature in the range of 800° C. to 1200° C. under an inert atmosphere of Ar or under vacuum to form an ingot which is free of said α-Fe phase;

hydrogenating said ingots in hydrogen gas in order to hydrogenate the R-rich constituents;

coarsely pulverising said ingot to form a coarsely pulverised powder;

performing a fine pulverisation of said coarsely pulverised powder in an atmosphere comprising oxygen, thereby forming an oxidized, finely pulverised powder;

wherein said finely pulverised powder comprises an oxygen content of 0.25 wt %<O≦0.5 wt %.

2. The method to produce powders for use in R—Fe—B-M type permanent magnets according to claim 1, wherein R is one or more of the elements Nd, Pr, Dy and Tb, 0.50%<Co<1.5%, 0.05%<Ga<0.25% and 0.05%<Cu<0.20%.

3. The method to produce powders for use in R—Fe—B-M type permanent magnets according to claim 1, wherein said finely pulverised powder has an average particle size (FSSS) in the range of 4 μm to 2.1 μm and contains no particles greater than 20 μm.

4. The method to produce powders for use in R—Fe—B-M type permanent magnets according to claim 1, wherein said finely pulverised powder has an average particle size (FSSS) in the range of 2.5 μm to 3 μm and no particles greater than 15 μm.

5. The method to produce powders for use in R—Fe—B-M type permanent magnets according to claim 1, wherein said ingot has its smallest dimensions in the range of 5 mm to 30 mm.

6. The method to produce powders for use in R—Fe—B-M type permanent magnets according to claim 1, wherein said ingot has its smallest dimensions in the range of 15 mm to 25 mm and said finely pulverised powder has an average particle size (FSSS) in the range of 4 μm to 2.1 μm and no particles greater than 20 μm.

7. The method to produce powders for use in R—Fe—B-M type permanent magnets according to claim 1, wherein said hydrogenating is performed at a temperature between 450° C. and 600° C.

8. The method to produce powders for use in R—Fe—B-M type permanent magnets according to claim 1, wherein said hydrogenating is performed at a temperature between 500° C. and 550° C.

9. The method to produce powders for use in R—Fe—B-M type permanent magnets according to claim 7, wherein said hydrogenating is performed under a pressure of 0.5 to 1.5 bars of hydrogen gas for a time period of between 1 hour and 10 hours.

10. The method to produce powders for use in R—Fe—B-M type permanent magnets according to claim 9, wherein said hydrogenating is performed at a pressure of around 1 bar of hydrogen for a time period of 5 hours.

11. The method to produce powders for use in R—Fe—B-M type permanent magnets according to claim 8, wherein said hydrogenating is performed under a pressure of 0.5 to 1.5 bars of hydrogen gas for a time period of between 1 hour and 10 hours.

12. The method to produce powders for use in R—Fe—B-M type permanent magnets according to claim 11, wherein said hydrogenating is performed at a pressure of 1 bar of hydrogen for a time period of 5 hours.

13. The method to produce powders for use in R—Fe—B-M type permanent magnets according to claim 1, further comprising cooling said ingot to a temperature of 100° C. under Ar gas after said hydrogenating.

14. The method to produce powders for use in R—Fe—B-M type permanent magnets according to claim 1, wherein said fine pulverisation comprises a first fine pulverisation and a second fine pulverisation.

15. The method to produce powders for use in R—Fe—B-M type permanent magnets according to claim 14, wherein the first fine pulverisation comprises pulverisation of said coarsely pulverised powder is in an inert atmosphere to form a first finely pulverised powder, and wherein said second fine pulverisation comprises pulverisation of said first finely pulverised powder in an atmosphere comprising oxygen, thereby oxidizing said alloy, to form a second finely pulverised powder that comprises an oxygen content 0.25 wt %<O≦0.5 wt %.

16. The method to produce powders for use in R—Fe—B-M type permanent magnets according to claim 14, wherein said first fine pulverisation and said second fine pulverisation are performed using a jet mill.

17. The method to produce powders for use in R—Fe—B-M type permanent magnets according to claim 14, wherein said first finely pulverised powder has an average particle size (FSSS) of 4 μm, and a particle size distribution wherein 30% of grains have a diameter of more than 10 μm, and 1% of grains have a diameter of greater than between 20 μm and 25 μm.

18. The method to produce powders for use in R—Fe—B-M type permanent magnets according to claim 14, wherein said second finely pulverised powder has an average particle size (FSSS) in the range of 4 μm to 2.1 μm and contains no particles greater than 20 μm.

19. The method to produce powders for use in R—Fe—B-M type permanent magnets according to claim 14, wherein said first finely pulverised powder has an average particle size (FSSS) of 4 μm and a particle size distribution, wherein 30% of grains have a particle diameter of more than 10 μm, and 1% have a diameter of greater of between 20 μm and 25 μm, and wherein said second finely pulverised powder has an particle grain size (FSSS) in the range of 4 μm to 2.1 μm and contains no particles greater than 10 μm.

20. A method of producing a powder for use in the manufacture of R—Fe—B-M type permanent magnets, comprising:

providing an alloy consisting of, by weight, $28.00 \leqq R \leqq 32.00\%$, where R is at least one rare earth element including Y and the sum of Dy+Tb>0.5, $0.50 \leqq B \leqq 2.00\%$, $0.50 \leqq Co \leqq 3.50\%$, $0.050 \leqq M \leqq 0.5\%$, where M is one or more of the elements Ga, Cu and Al, 0.25 wt %<O≦0.5%, 0.15% or less of C, 0.15% or less of N, balance Fe, said alloy having the form of an ingot which comprises finely dispersed α-Fe phase, and $R_2Fe_{14}B$ and R-rich constituents;

annealing said ingot at a temperature in the range of 800° C. to 1200° C. under an inert atmosphere of Ar or under vacuum to form an ingot which is free of said α-Fe phase;

hydrogenating said ingots in hydrogen gas in order to hydrogenate the R-rich constituents;

coarsely pulverising said ingot to form a coarsely pulverised powder;

performing a fine pulverisation of said coarsely pulverised powder in an atmosphere comprising oxygen, thereby forming an oxidized, finely pulverised powder;

wherein said finely pulverised powder comprises an oxygen content of 0.25 wt %<O≦0.5 wt %.

21. The method of producing powders for use in the manufacture of R—Fe—B-M type permanent magnets according to claim 20, wherein R is one or more of the elements Nd, Pr, Dy and Tb, 0.50%<Co<1.5%, 0.05%<Ga<0.25% and 0.05%<Cu<0.20%.

22. The method of producing powders for use in the manufacture of R—Fe—B-M type permanent magnets according to claim 21, wherein said finely pulverised powder has an average particle size (FSSS) in the range of 2.5 μm to 3 μm.

23. The method to produce powders for use in a rare earth magnet according to claim 21, wherein said ingot has dimensions in the range of 15 mm to 25 mm.

24. The method to produce powders for use in a rare earth magnet according to claim 23, wherein said hydrogenating is performed at a temperature of between 450° C. and 600° C.

25. The method to produce powders for use in a rare earth magnet according to claim 23, wherein said hydrogenating is performed at a temperature of between 500° C. and 550° C.

26. The method to produce powders for use in a rare earth magnet according to claim 24, wherein said hydrogenating is performed under a pressure of 0.5 to 1.5 bars of hydrogen gas for a time period between 1 hour and 10 hours.

27. The method to produce powders for use in a rare earth magnet according to claim 26, wherein said hydrogenating is performed at a pressure of around 1 bar hydrogen for a time period of 5 hours.

28. The method to produce powders for use in a rare earth magnet according to claim 25, wherein said hydrogenating is performed under a pressure of 0.5 to 1.5 bars of hydrogen gas for a time period between 1 hour and 10 hours.

29. The method to produce powders for use in a rare earth magnet according to claim 28, wherein said hydrogenating is performed at a pressure of 1 bar hydrogen for a time period of 5 hours.

30. The method to produce powders for use in a rare earth magnet according to claim 20, wherein further comprising cooling said ingot to a temperature of 100° C. under Ar gas after said hydrogenating.

* * * * *